US005690163A

United States Patent [19]

Leadbeatter et al.

[11] Patent Number: 5,690,163

[45] Date of Patent: Nov. 25, 1997

[54] STRIP CASTING

[75] Inventors: Darren John Leadbeatter, Dapto; Andrew Arthur Shook, Adamtown Heights; John Curtis, Albion Park; Colin Robert Dean, Oak Flats, all of Australia

[73] Assignees: Ishikawajima-Harima Heavy Industries Company Limited, Tokyo, Japan; BHP Steel (JLA) Pty Ltd, Melbourne, Australia

[21] Appl. No.: 715,330

[22] Filed: Sep. 18, 1996

[30] Foreign Application Priority Data

Sep. 19, 1995 [AU] Australia ..... PN 5482

[51] Int. Cl.[6] ..... B22D 11/00; B22D 11/06

[52] U.S. Cl. ..... 164/480; 164/483

[58] Field of Search ..... 164/428, 480, 164/483

[56] References Cited

U.S. PATENT DOCUMENTS 5,287,912 2/1994 Folder et al. ..... 164/480

*Primary Examiner*—Kuang Y. Lin

*Attorney, Agent, or Firm*—Nikaido, Marmelstein, Murray & Oram LLP

[57] ABSTRACT

Molten metal is introduced between a pair of parallel casting rolls (16) of a twin roll caster by metal delivery apparatus comprising a distributor vessel (18) and delivery nozzle (19) to form a casting pool (10) above the nip (30) between the rolls (16). The rolls (16) are rotated so as to cast a solidified strip (20) delivered downwardly from the nip (30). Casting of the strip is terminated by stopping the flow of metal to the delivery apparatus (18, 19) and allowing the quantity of molten metal in the delivery apparatus to run down to a reduced quantity at which there is still molten metal in the casting pool and then moving one or both casting rolls laterally to increase the gap between the rolls whereby to interrupt formation of the strip and allow downward discharge of the remaining metal through the increased gap between the rolls.

13 Claims, 6 Drawing Sheets

STRIP CASTING

BACKGROUND OF THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are chilled so that metal shells solidify on the moving roll surfaces and are brought together at the nip between them to produce a solidified strip product delivered downwardly from nip between the rolls. The term "nip" is used herein to refer to the general region at which the rolls are closest together. The molten metal may be poured from a ladle into metal delivery apparatus which may take the form of one or more smaller vessels as a tundish and/or distributor and a delivery nozzle, the metal flowing through such smeller vessel or vessels to the delivery nozzle which directs between the rolls, so forming a casting pool of molten metal supported immediately above the nip. This casting pool may be confined between side plates or dams held in sliding engagement with the ends of the rolls.

Damage to the casting roll surfaces is a major problem in the operation of a twin roll caster, particularly when casting ferrous metals. The peripheral walls of the rolls are generally made of copper which are electroplated with chrome or some other coating and are carefully machined to provide casting surfaces of very accurate shape and surface finish. They are very susceptible to damage and any slight mark or scratch will result in a strip defect. The rolls are very expensive and difficult to repair and the prevention of marks on the casting surfaces is of great importance.

It has previously been thought that marking of the roll surfaces was caused by the passage of solid inclusions through the nip between the rolls during normal casting and that some marking of the rolls could not be avoided. It was therefore accepted that the rolls would need to be replaced and repaired at frequent intervals, sometimes after only a single cast. However, we have now determined that marking of the roll surfaces generally does not occur during normal casting and that the metal shells Which solidify on the moving roll surfaces and are brought together at the nip during normal casting actually protect the rolls from marking by solid inclusions passing through the nip. These shells actually act as "armour" for the casting surfaces during normal casting. The protection thus afforded by the solidified metal shells coming to the nip is so effective that it is possible deliberately to pass solid foreign material such as steel balls through the nip to cause the casting rolls to be sprung apart without damaging the casting surfaces. We have further determined that most of the marking of the casting roll surfaces occurs at the end of normal casting when the formation of the metal shells on the casting surfaces is interrupted at the same time that metal drips, solid inclusions and general debris from the casting pool are passed through the nip. The present invention provides a method whereby such marking of the roll surfaces can be largely avoided by following an appropriate practice at the end of a casting run.

SUMMARY OF THE INVENTION

According to the invention there is provided a method of casting metal strip of the kind in which molten metal is introduced between a pair of parallel casting rolls of a twin roll caster via a metal delivery apparatus to form a casting pool of molten metal supported above the nip between the rolls and rotating the rolls so as to cast a solidified strip delivered downwardly from the nip, comprising terminating casting of strip by stopping the flow of metal to the metal delivery apparatus and allowing the quantity of molten metal in the delivery apparatus to run down to a reduced quantity at which there is still molten metal in the casting pool and continuous strip continues to be cast and then increasing the gap between the casting rolls at the nip by moving at least one of the casting rolls laterally sufficient to interrupt the formation of the strip and to allow downward discharge of said reduced quantity of molten metal through the increased gap between the rolls.

Said increase of the gap between the rolls may be such that the gap is increased to more than 20 mm.

The increase of the gap between the rolls may be achieved by moving both of the rolls laterally apart. Such movement may be achieved by the operation of hydraulic or pneumatic actuators.

The metal delivery apparatus may comprise a tundish and/or metal distributor to receive molten metal from a ladle and a delivery nozzle to receive molten metal from the tundish and/or distributor and deliver it to the nip between the casting rolls. Said reduced quantity of molten metal may then be such that the tundish and/or distributor has been drained of molten metal before the roll gap is increased.

The reduced quantity of molten metal may further be such that the delivery nozzle has been drained of molten metal before the roll gap is increased.

Where there is both a tundish and a subsequent metal distributor, the metal distributor may be drained shutting off the flow from the tundish.

The reduced quantity of molten metal may further be such that the level of molten metal in the casting pool falls to an abnormal level before the roll gap is increased.

More generally, said reduced quantity of the molten metal may be less than the quantity maintained in the casting pool during normal casting. In that case the method may include the step of monitoring the level of the casting pool after the flow of molten metal to the metal delivery apparatus has been stopped and increasing the gap between the casting rolls when the pool level drops to a level corresponding to said reduced quantity.

BRIEF DESCRIPTION OF DRAWINGS

In order that the invention may be more fully explained, one particular form of apparatus and its operation will now be described in some detail with reference to the accompanying drawings in which.

DESCRIPTION OF PREFERRED EMBODIMENT

Figure 1:
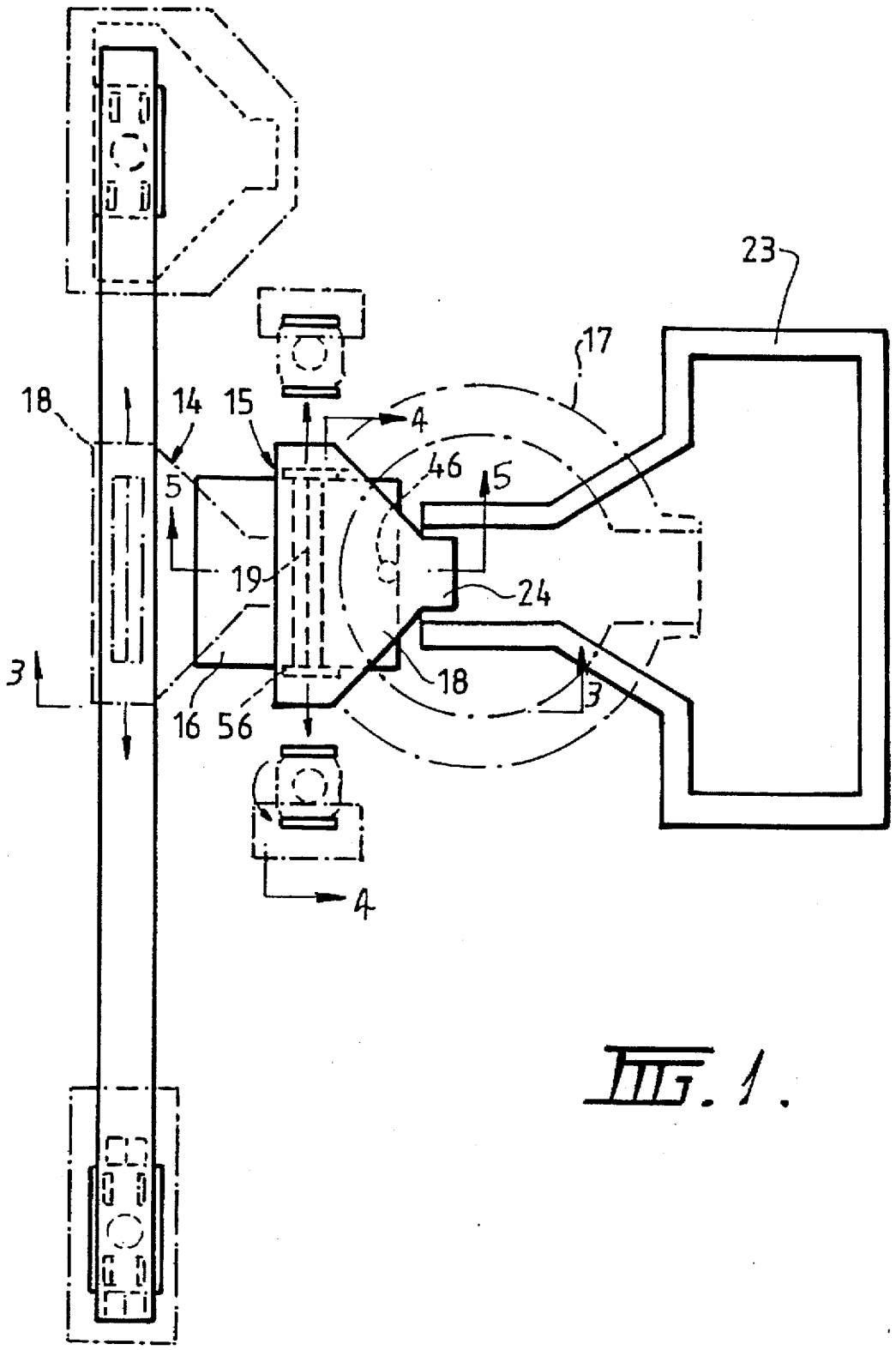
FIG. 1 is a plan view of a continuous strip caster constructed to operate in accordance with the invention.
Figure 2:
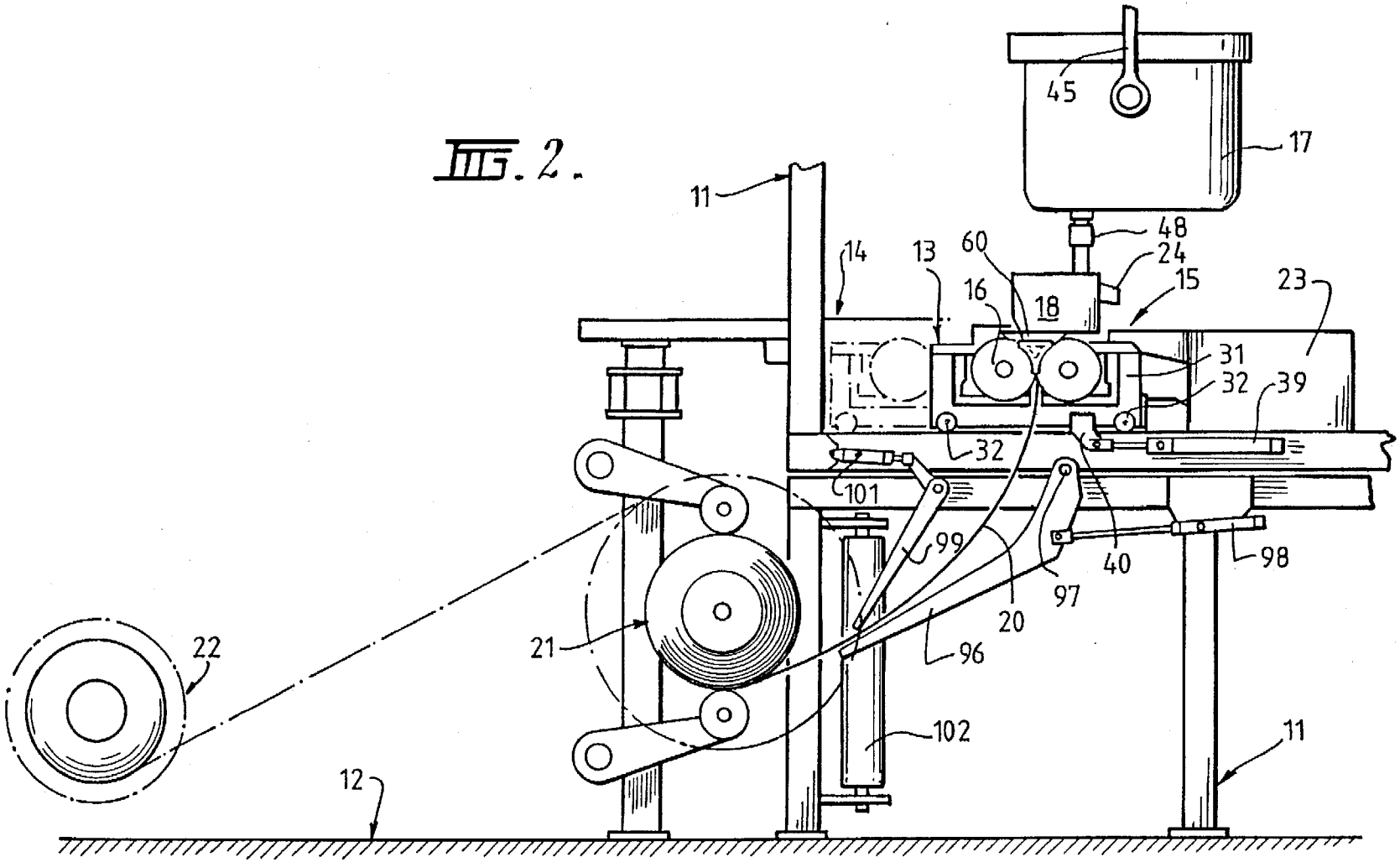
FIG. 2 is a side elevation of the strip caster shown in FIG. 1.
Figure 3:
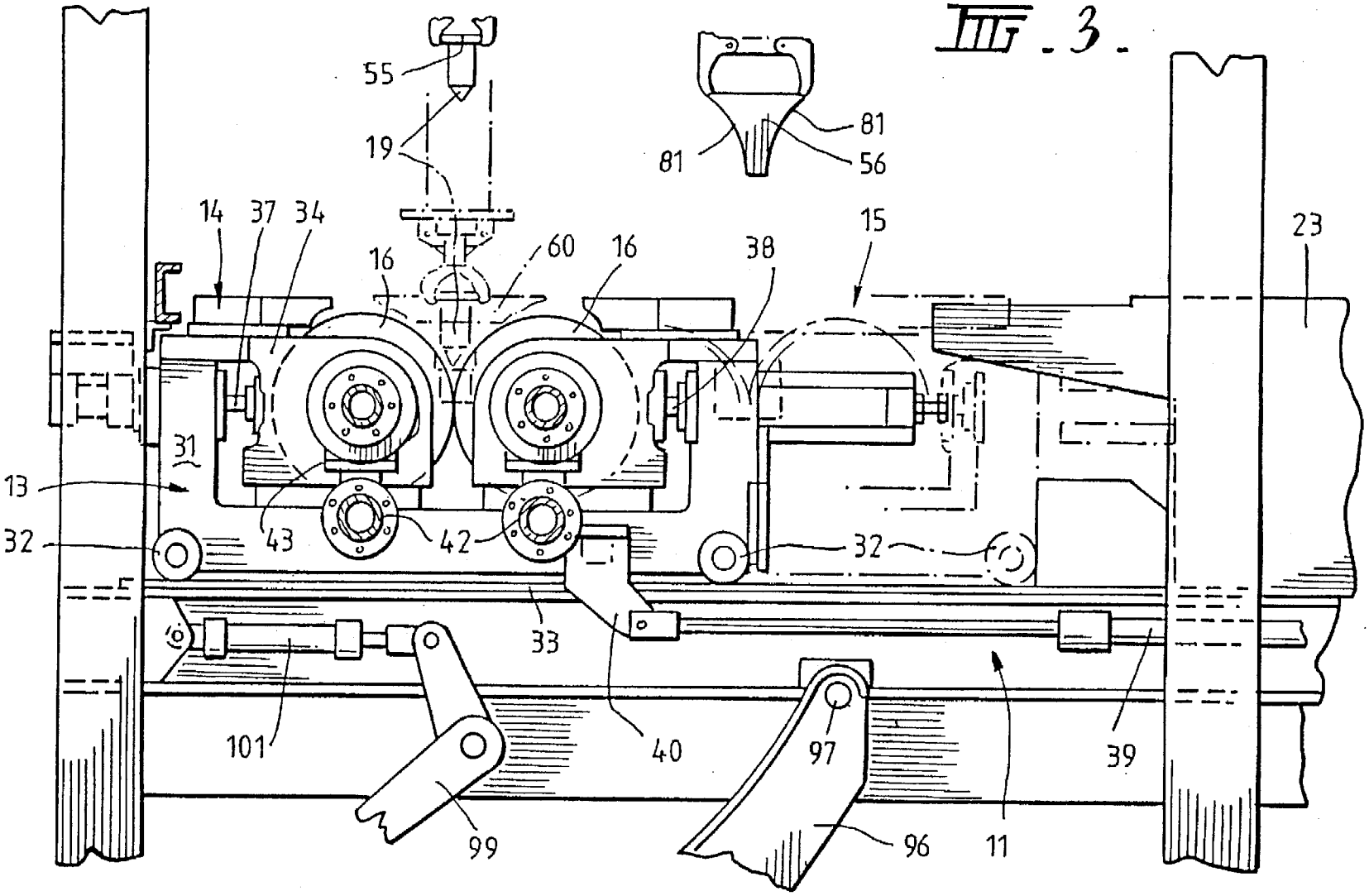
FIG. 3 is a vertical cross-section on the line 3—3 in FIG. 1.
Figure 4:
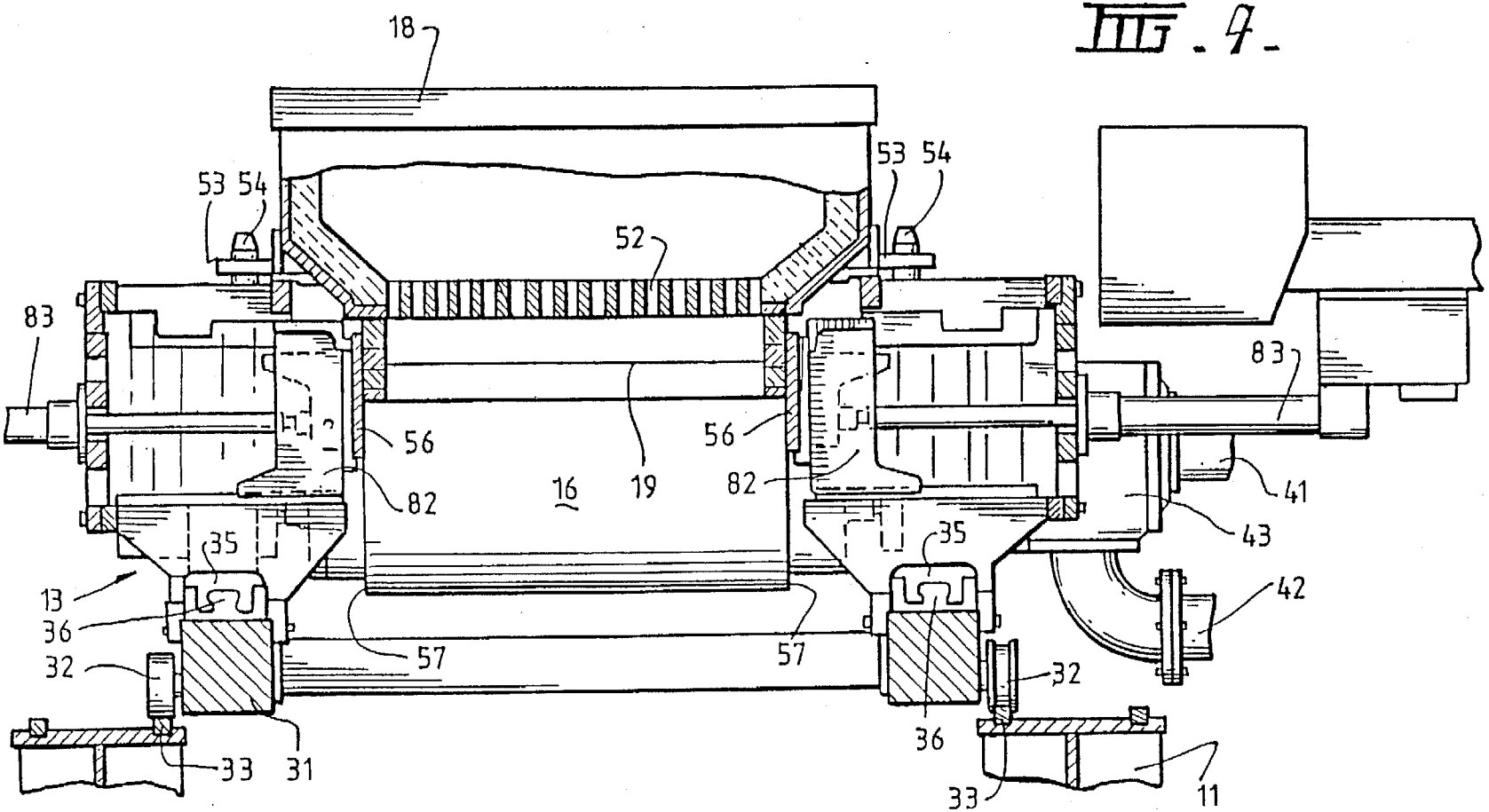
FIG. 4 is a vertical cross-section on the line 4—4 in FIG. 1.
Figure 5:
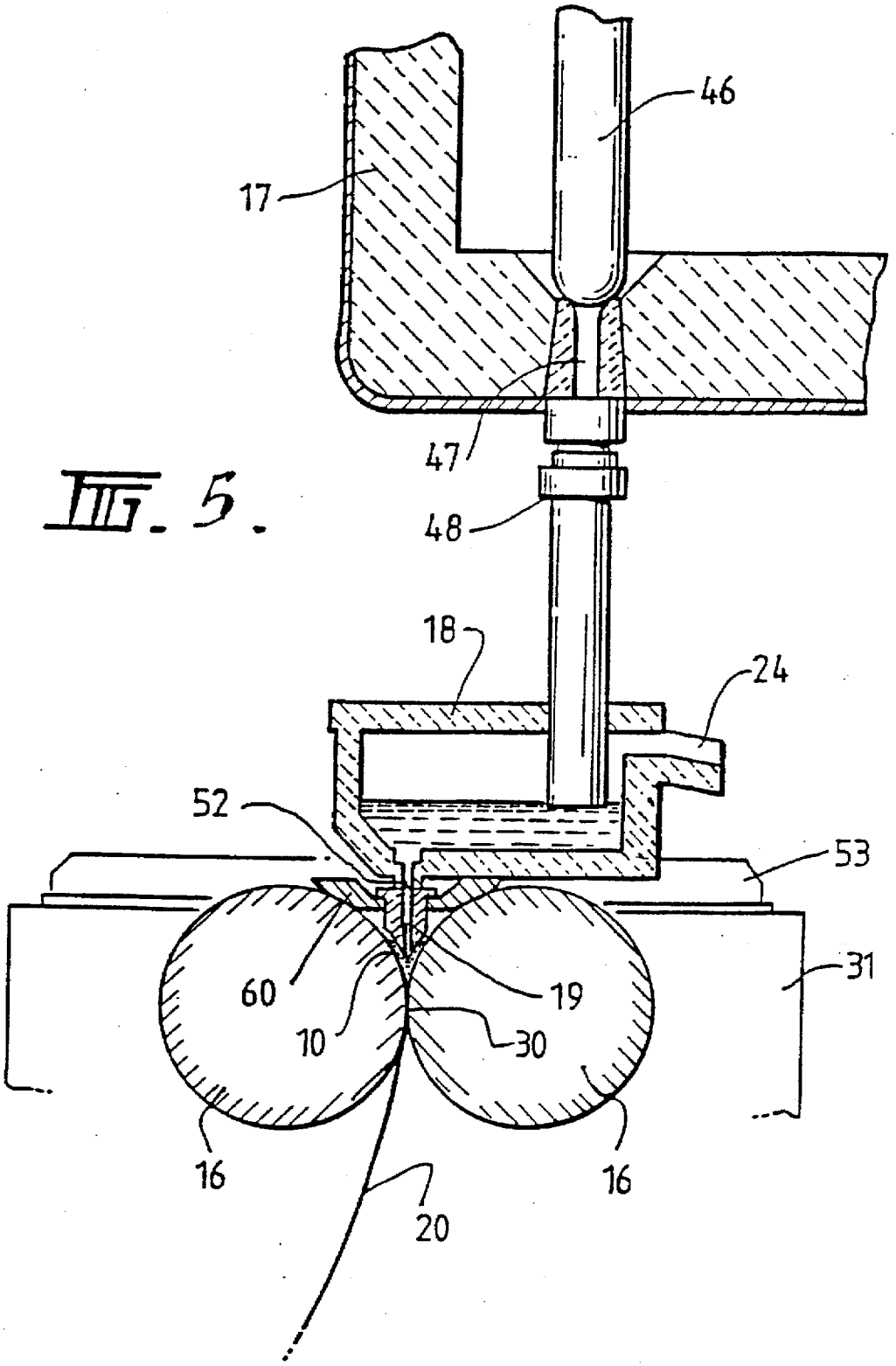
FIG. 5 is a vertical cross-section on the line 5—5 of FIG. 1.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a metal delivery apparatus 10 comprising a distributor 18 and delivery nozzle 19 to produce a casting pool 10 of molten metal. Casting rolls 16 are water cooled so that shells solidify on the moving roll surfaces and are brought together at the nip 30 between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16 and to enable the rolls to be rapidly moved apart when it is required to terminate the cast as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. Each roll may typically be about 500 mm diameter and up to 2000 mm wide in order to produce strip product approaching that width.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is also of conventional construction. It is formed as a wide dish made of a refractory material such as magnesium oxide (MgO). One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as to accurately locate the distributor.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls. Alternatively, the nozzle may have a single continuous slot outlet to deliver a low velocity curtain of molten metal directly into the nip between the rolls. The nozzle may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to Dour from the ladle and through the metal delivery apparatus to the casting rolls. After a head end of the strip product 20 is produced, that head end is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rolls 102. After the head end has been guided into the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Figure 6:
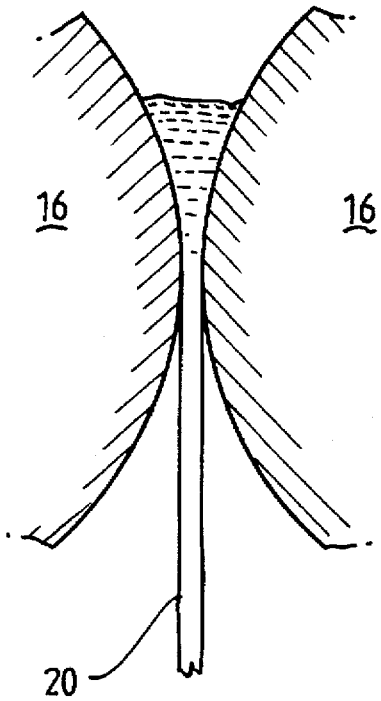
FIG. 6 illustrates the production of strip during normal continuous casting.
Figure 7:
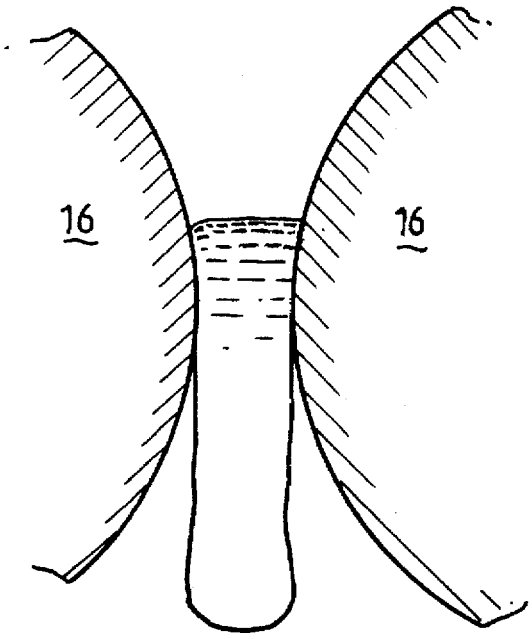
FIG. 7 illustrates separation of the casting rolls to terminate casting.

FIG. 6 illustrates the normal spacing between the casting rolls 16 during continuous casting of strip product 20 whereas FIG. 7 illustrates a dramatic increase in the gap between the rolls at the nip which is generated by operation of the hydraulic cylinder units 37, 38 to move the roll cradles 34 rapidly away from each other in order to terminate the cast in accordance with the practice of the present invention. Casting of the strip is thus suddenly interrupted and the remaining molten metal in the casting pool simply drops downwardly between the casting rolls to waste.

The precise timing of the roll separation movement is not particularly critical and the choice involves a trade-off between the yield sacrificed due to the discharge of uncast molten metal against the risk of roll damage which can result if the molten metal in the casting pool is disturbed or drops to a level at which continuous casting is interrupted and the protection of the solidifying shells on the casting surfaces is broken. It would be possible to interrupt the cast by opening the roll gap soon after the supply of molten metal from the ladle is stopped and while molten metal is still draining through the distributor and metal delivery nozzle. This would insure against damage to the casting roll surfaces but would result in a significant yield sacrifice. Alternatively, the rolls could be separated as soon as the distributor has drained and before the casting pool level drops significantly. The actual timing will depend to some extent on the kind of metal delivery apparatus employed but with careful control it is possible to delay termination of the cast until the casting pool has fallen to an abnormally low level, thus permitting drainage of the complete metal delivery apparatus including the delivery nozzle 19. The casting rolls 16 may be rotated at a reduced speed as the level of molten metal in the casting pool falls to the abnormally low level so as to increase the time for drainage of molten metal from the metal delivery apparatus. The reduction in the speed of rolls 16 may be initiated when the pool level starts to fall at some earlier time. The spacing between the rolls must be adjusted to accommodate the slower casting speed which results in a thickening of the cast strip.

The level of the casting pool may be monitored by an appropriate inspection system and the cast may be terminated manually by operation of the hydraulic cylinder units 37, 38 or automatically by an appropriate control connection between a pool level monitor and the hydraulic cylinder units. An appropriate pool level monitor is described in our Japanese Patent Application 281609/95. In alternative arrangements the rate of metal flow or the level of metal in some part of the metal delivery apparatus could be used to trigger the separation of the rolls.

We claim:

1. In a method of casting metal strip by introducing molten metal between a pair of parallel casting rolls of a twin roll caster via a metal delivery apparatus to form a casting pool of molten metal supported above the nip between the rolls and rotating the rolls so as to cast a solidified strip delivered downwardly from the nip, the improvement comprising terminating casting of strip by stopping the flow of metal to the metal delivery apparatus and allowing the quantity of molten metal in the caster to run down to a reduced quantity at which there is still molten metal in the casting pool and continuous strip continues to be cast and then increasing the gap between the casting rolls at the nip by moving at least one of the casting rolls laterally sufficient to interrupt the formation of the strip and to allow downward discharge of said reduced quantity of molten metal through the increased gap between the rolls.

2. The improved method as claimed in claim 1, wherein said increase of the gap between the rolls is such that the gap is increased to more than 20 mm.

3. The improved method as claimed in claim 2, wherein the increase of the gap between the rolls is achieved by moving both of the rolls laterally apart.

4. The improved method as claimed in claim 3, wherein the rolls are moved laterally apart by the operation of hydraulic or pneumatic actuators.

5. The improved method as claimed in claim 1, wherein the metal delivery apparatus comprises a vessel to receive molten metal from a ladle and a delivery nozzle to receive molten metal from said vessel and deliver it to the nip between the casting rolls.

6. The improved method as claimed in claim 5, wherein said reduced quantity of molten metal is such that said vessel is drained of molten metal before the roll gap is increased.

7. The improved method as claimed in claim 6, wherein said vessel is a distributor vessel, said molten metal is delivered to that vessel from the ladle through a tundish and the distributor vessel is drained by shutting off the flow from the tundish.

8. The improved method as claimed in claim 6, wherein said reduced quantity of molten metal is such that the delivery nozzle is drained of molten metal before the roll gap is increased.

9. The Improved method as claimed in claim 1, wherein said reduced quantity of molten metal is such that the level of molten metal in the casting pool falls to an abnormal level before the roll gap is increased.

10. The improved method as claimed in claim 9, wherein said reduced quantity of molten metal is less than the quantity maintained in the casting pool during normal casting.

11. The improved method as claimed in claim 10, which includes the steps of monitoring the level of the casting pool after the flow of molten metal to the metal delivery apparatus has been stopped and increasing the gap between the casting rolls when the pool level drops to a level corresponding to said reduced quantity.

12. The improved method as claimed in claim 9, wherein the casting rolls are rotated at a reduced speed as the level of molten metal in the casting pool falls to said abnormal level so as to increase the time for drainage of molten metal from the metal delivery apparatus.

13. The improved method as claimed in claim 12, wherein the gap between the casting rolls is adjusted to match the increased thickness of the casting strip due to the reduced casting speed on reduced speed of rotation of the casting rolls.

* * * * *